United States Patent [19]

Dogadko

[11] Patent Number: 4,671,225

[45] Date of Patent: Jun. 9, 1987

[54] TIMED PRIMING SYSTEM WITH TEMPERATURE OVERRIDE

[75] Inventor: Peter Dogadko, Chicago, Ill.

[73] Assignee: Outboard Marine Corporation, Waukegan, Ill.

[21] Appl. No.: 761,475

[22] Filed: Aug. 1, 1985

[51] Int. Cl.[4] ..... F02M 1/10

[52] U.S. Cl. ..... 123/187.5 R; 123/180 E; 123/180 T

[58] Field of Search ..... 123/187.5 R, 179 G, 123/179 L, 180 E, 180 T

[56] References Cited

U.S. PATENT DOCUMENTS

| | | | |
|---|---|---|---|
| 3,704,702 | 12/1972 | Aono | 123/187.5 R |
| 3,716,034 | 2/1973 | Schmid | 123/179 G |
| 3,827,417 | 8/1974 | Morita | 123/187.5 R |
| 4,284,040 | 8/1981 | Baltz et al. | 123/187.5 R |
| 4,441,467 | 4/1984 | Powell | 123/179 G |

*Primary Examiner*—Andrew M. Dolinar

*Attorney, Agent, or Firm*—Michael, Best & Friedrich

[57] ABSTRACT

The two cycle engine has a combustion chamber supplied with primary fuel for normal operation. An electrically operated priming system delivers fuel in addition to the primary fuel. A control regulates energization of the priming system. A momentary switch energizes the priming system when the switch closes and enables the control when the switch opens. The control causes the priming system to operate a predetermined period of time after the control is enabled but is subject to override by a switch responsive to engine temperature. Thus the priming system is shut down by the temperature responsive switch when engine temperature exceeds a predetermined value. The timing function of the control is provided by an integrated circuit chip wired as a timer. When the engine is started the timer chip is reset to zero and the timer starts timing when the momentary switch opens.

6 Claims, 2 Drawing Figures

TIMED PRIMING SYSTEM WITH TEMPERATURE OVERRIDE

BACKGROUND OF THE INVENTION

This invention relates to a priming system for two cycle engines. Priming is old but this invention provides electrically operated priming which is timed on starting and is subject to temperature override.

Morita U.S. Pat. No. 3,827,417 shows a cold starting device which has a switch which is closed to start a timer to energize an oil pump to supply oil to the throttle plate of a carburetor for 3 seconds. The oil is to enhance the seal between the piston rings and the cylinder wall. The present design has a switch which is closed to prime the engine with added gasoline and has timing means responsive to switch opening to provide timed operation of the priming means for a given time or until the engine temperature reaches a predetermined value. The present design allows the operator to prime the engine whenever that is perceived as desireable.

SUMMARY OF THE INVENTION

This invention is applied to an engine having an engine block which includes a combustion chamber. A primary fuel supply delivers fuel to the chamber. An electrically operated priming device delivers fuel to the chamber in addition to that delivered by the primary supply. A switch is operative to energize the priming device and enables a control means which regulates energization of the priming device to deliver fuel to the chamber. The control is operative a predetermined period of time following enabling by operation of the switch. The invention also provides a switch responsive to engine temperature to prevent operation of the priming device by the control when engine temperature exceeds a predetermined value.

A further feature is the provision of a primary fuel supply for delivering fuel to the combustion chamber of an internal combustion engine. An electrically operated priming device delivers fuel to the combustion chamber in addition to that delivered by the primary supply. A control is operative to provide timed operation of the priming means and a switch is operative when closed to energize the priming device independantly of the control. The control is responsive to opening of the switch to initiate timed operation. The invention contemplates that the switch is a momentary switch and the control includes an electronic timer and a circuit responsive to application of electric power to the circuit to reset the timer. A power switch applies electric power to the circuit when the engine is put into use.

A temperature responsive switch disables the control in response to a predetermined engine temperature.

A further feature is the provision of a primary supply for delivering fuel to the combustion chamber of an internal combustion engine. An electrically operated primer delivers fuel to the chamber in addition to that delivered by the primary supply. A control provides timed operation of the primer. A switch is operative when closed to energize the primer while the control is responsive to reopening of the switch to initiate the timed operation.

This invention is not limited to the details of construction and the arrangement of components set forth in the following description or illustrated in the drawings. The invention is capable of other embodiments and of being practiced and carried out in various ways.

Also, it is to be understood that the phraseology and terminology employed herein is for the purpose of description and should not be regarded as limiting.

DESCRIPTION OF THE DRAWINGS

FIG. 2 identifies various circuit components by value and/or commercial designation. Generally these descriptive terms are not repeated in the following description. They are not intended to be limiting but instead are given to enable those in the art to understand the circuit details. Some components are identified in the circuit diagram but are not mentioned in the description because they are used in usual and customary ways.

DETAILED DESCRIPTION OF THE DRAWINGS

Figure 1:
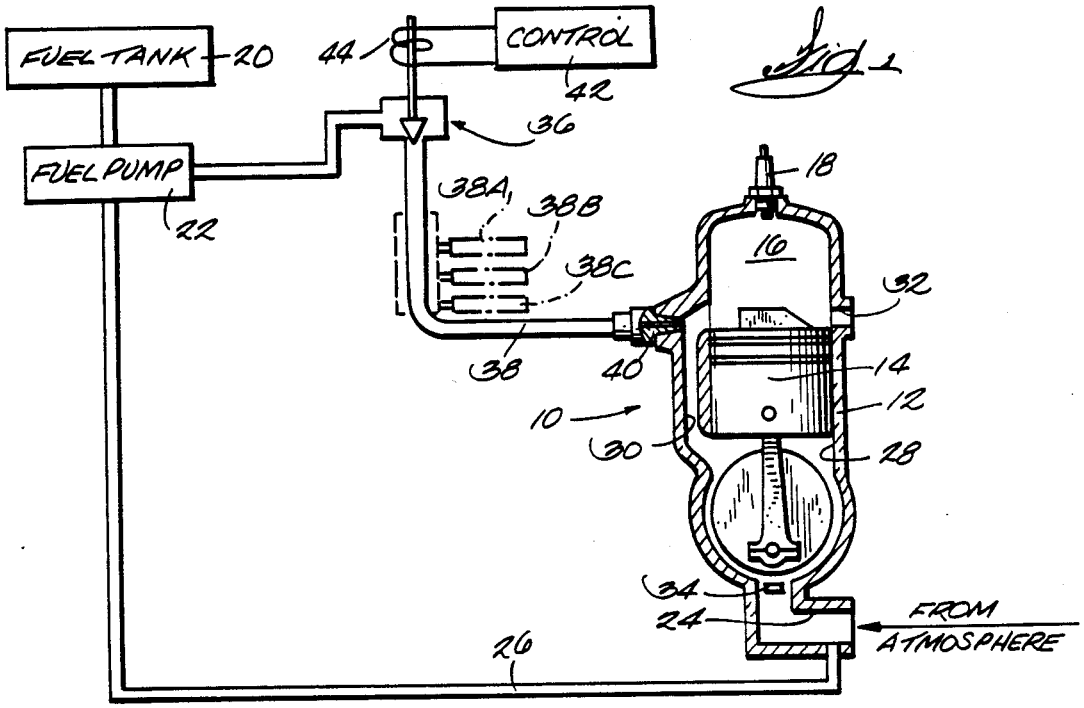
FIG. 1 is a diagramatic layout of this system.

FIG. 1 is a schematic illustration of an internal combustion engine 10 having an engine block 12 which has a cylinder in which piston 14 reciprocates. The air/fuel mixture in the combustion chamber 16 above the piston is ignited by spark plug 18.

The primary fuel supply for the engine includes a pump 22 drawing fuel from tank or source 20 and delivering it to the intake manifold 24 through conduit 26. The fuel and the incoming air are mixed in the manifold 24 and in the crankcase 28 and then the mixture is transferred to the combustion chamber through transfer passage 30. After the power stroke of the engine, the gas is exhausted through exhaust port 32. The reed valve 34 between the manifold 24 and the crankcase 28 controls the induction of air to the crankcase 28.

Electrically operated priming means provides for cold start and warm-up of the engine. The priming means includes a solenoid valve 36 which is opened to permit fuel to flow from pump 22 through conduit 38 to nozzle 40 which will spray the fuel directly into the combustion chamber 16 to provide priming fuel which is in addition to the primary fuel supply, thus enriching the mixture to ensure easy starting and warm-up. This manner of enriching the fuel supply is well known and has recognized advantages, but, if desired, the enrichment can take place at the intake manifold even though that is not as desirable from the functional standpoint.

Figure 2:
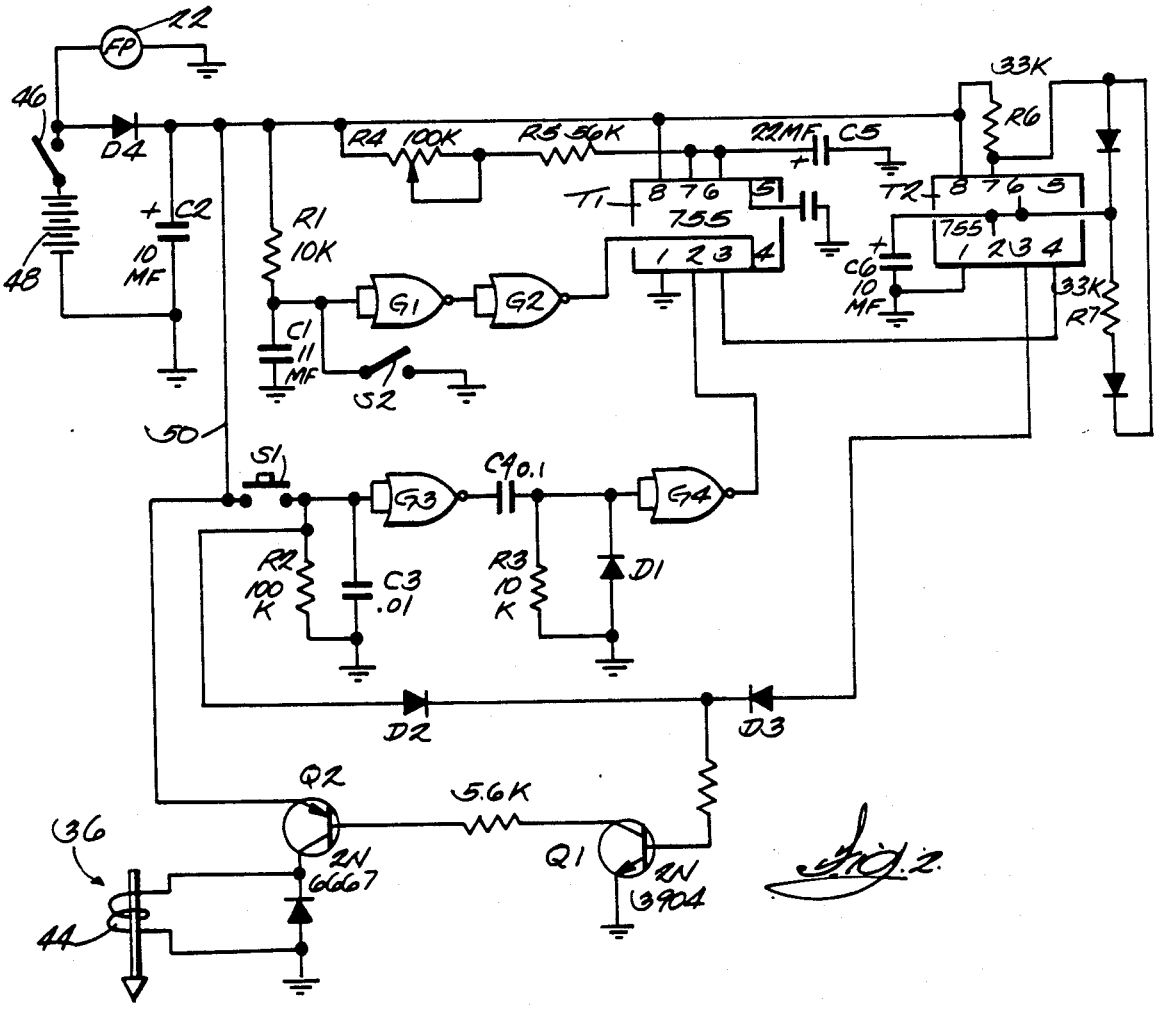
FIG. 2 is a wiring diagram of the control 46 in FIG. 1 combined with a schematic representation of a fuel pump and solenoid valve.

The operation of the solenoid valve 36 is regulated by control means depicted by the box 42 in FIG. 1 and comprising most of FIG. 2. The valve can supply fuel to a single cylinder (as illustrated in FIG. 1) or, if desired, can optionally provide fuel to additional cylinders generally as depicted by the schematic representation of additional conduits 38A, B and C.

The solenoid valve 36 is gravity and/or spring biased to closed position. When the coil 44 is energized the valve will open to supply priming fuel to the combustion chamber 16. The coil 44 can be energized continuously or intermittently, as will appear hereinafter. It should be appreciated that in lieu of a solenoid valve regulating flow from the fuel pump 22 to the nozzle 40, a separate fuel pump can be provided if desired. In either event, the control 42 (depicted in FIG. 2) would have substantially the same operating characteristics and achieve substantially the same ends, as will be described.

Typically, an internal combustion engine is provided with a key operated ignition switch 46 having three steps: "off", "on" and "start". Typically, the switch is biased away from the "start" position so that upon release of the key after the engine starts, the key switch returns to the "on" position. When key switch 46 is closed, ("on") the fuel pump is energized and the DC power supply of battery 48 is applied to the control means 42 shown in FIG. 2. Thus, current flows through the diode D4 and resistance R1 to be applied to NOR gate G1 which, after the capacitor C1 and C2 are charged, will invert the positive input to a negative output which is inverted by gate G2 back to a positive output which is applied to input 4 of the 755 timer chip T1 connected to operate as a one-shot timer. A positive input on pin 4 resets timer T1. Thus, closing the ignition switch 46 resets the timer T1.

Closure of the ignition switch 46 will also supply voltage to switch means S1 through lead 50. Switch S1 is a normally open, momentary closed priming switch biased open and manually pushed to close. S1 will open again when the switch is released. Closing switch S1 will apply voltage to the base of transistor Q1 through diode D2. This will cause Q1 to conduct which will, in turn, cause the transistor Q2 to conduct. This will energize the coil 44 of the solenoid valve 36 to open the valve 36. The valve will remain open as long as switch S1 is closed. The operator simply depresses S1 momentarily when it is desired to prime the engine. On release of S1, the switch opens and now a positive pulse is created at the output of NOR gate G3. This positive pulse is shaped by R3 and C4 to provide a narrow pulse which is applied to NOR gate G4 which puts out a negative pulse which is applied to pin 2 of timer T1. This activates the timer T1 to provide a positive output at pin 3 for the time determined by R4, R5 and C5. The positive output at pin 3 is applied to pin 4 of timer T2 which is a 755 chip configured as a free-running oscillator with a frequency determined by R6, R7 and C6. Timer T2 outputs positive pulses at pin 3. These pulses are applied through diode D3 to the base of transistor Q1. That causes pulsed operation of Q1 which causes pulsed operation of transistor Q2 regulating energization of the coil 44 of the solenoid valve 36. Thus, the solenoid valve is pulsed at the frequency of the free-running oscillator T2. The oscillator T2 will continue operating for the period of time set by timer T1 providing the temperature of the engine is below the setting of the temperature responsive switcn S2. If the engine temperature reaches the temperature setting of S2, S2 will close to ground the input of gate G1. This will remove the positive signal on pin 4 of timer T1 and shut down the timer which, of course, then de-energizes the oscillator T2 and causes the solenoid valve 36 to close.

If the operator undertakes to prime the engine by depressing the momentary switch S1 when the engine is warm, (i.e. switch S2 is closed) the priming means will be operated while the switcn S1 is closed, but upon release of the switch the priming will stop. Timer T1 would not be reset under hot start conditions because the switch S2 would be closed and prevent applying a reset signal to the pin 4 of timer T1. Thus, the temperature responsive switch S2 prevents operation of the priming means when the engine temperature is above the predetermined temperature whether on starting or after running a while.

With this arrangement it will be noted that the priming means provides priming while the priming switch S1 is depressed. The control means also provides for timed operation of the timing means after the timing switch S1 is re-opened to cause the control timer to be enabled. The temperature responsive switch S2 overrides timed operation of the timing means when the engine temperature exceeds a predetermined value. Even when S2 is in the override mode closure of switch S1 will provide priming. The ignition switch 46 and switch S1 can be combined if desired.

I claim:

1. An engine having an engine block including a combustion chamber, primary fuel supply means for delivering fuel to said chamber, an electric power supply, electrically operated priming means responsive to energization thereof to deliver fuel to said chamber in addition to the fuel delivered by said primary means, control means operative to energize said priming means to deliver fuel to said chamber for a predetermined period of time following enablement thereof, switch means operative when closed to energize said priming means, and means responsive to said switch opening after being closed to enable said control means.

2. An engine according to claim 1 including means responsive to engine temperature to prevent operation of said priming means by said control means when engine temperature exceeds a predetermined value.

3. An engine according to claim 2 including means responsive to engine temperature to disable said control means when engine temperature exceeds a predetermined temperature.

4. An engine having an engine block including a combustion chamber, an electric power supply, primary fuel supply means for delivering fuel to said chamber, electrically operated priming means for delivering fuel to said chamber in addition to the fuel delivered by said primary means, switch means operative when closed to energize said priming means, and control means for maintaining said priming means energized in response to opening of said switch means to initiate timed operation of said priming means in response to opening of said switch means.

5. An engine according to claim 4 in which said switch means is a momentary switch, said control means including a resetable electronic timer and circuit means responsive to application of electric power to said circuit means to reset said timer, and including a power switch operative to apply electric power to said circuit means when the engine is put into use.

6. An engine according to claim 5 including a temperature responsive switch means operative to disable said control means in response to a predetermined engine temperature.

* * * * *